US011573506B2

(12) United States Patent
Mase et al.

(10) Patent No.: US 11,573,506 B2
(45) Date of Patent: Feb. 7, 2023

(54) POWDER CONTAINER, DEVELOPING DEVICE, AND IMAGE FORMING APPARATUS WITH MULTIPLE JOINTS TO PREVENT LEAKAGE

(71) Applicants: Ryusuke Mase, Kanagawa (JP); Yuki Oshikawa, Kanagawa (JP)

(72) Inventors: Ryusuke Mase, Kanagawa (JP); Yuki Oshikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/392,282

(22) Filed: Aug. 3, 2021

(65) Prior Publication Data

US 2022/0043370 A1 Feb. 10, 2022

(30) Foreign Application Priority Data

Aug. 5, 2020 (JP) ..... JP2020-133259

(51) Int. Cl.
*G03G 15/08* (2006.01)
*G03G 21/18* (2006.01)

(52) U.S. Cl.
CPC ..... *G03G 15/0891* (2013.01); *G03G 15/0865* (2013.01); *G03G 15/0896* (2013.01); *G03G 15/0898* (2013.01); *G03G 21/1821* (2013.01); *G03G 2221/1815* (2013.01)

(58) Field of Classification Search
CPC ..... G03G 15/0891; G03G 15/0865; G03G 15/0898; G03G 21/1821; G03G 15/0812; G03G 15/0894; G03G 15/0896; G03G 21/1814; G03G 2221/163; G03G 2221/1815; G03G 2215/0872
See application file for complete search history.

(56) References Cited

U.S. PATENT DOCUMENTS

| | | | | |
|---|---|---|---|---|
| 6,266,500 | B1 * | 7/2001 | Numagami | G03G 15/0942 399/104 |
| 2003/0156869 | A1 * | 8/2003 | Karakama | G03G 21/1814 399/350 |
| 2009/0180816 | A1 * | 7/2009 | Sato | G03G 15/0896 399/262 |
| 2011/0064454 | A1 * | 3/2011 | Xu | G03G 15/0812 399/284 |
| 2015/0086236 | A1 * | 3/2015 | Xu | G03G 21/181 399/284 |
| 2017/0205764 | A1 * | 7/2017 | Torii | G03G 15/0898 |
| 2020/0174400 | A1 | 6/2020 | Kawashima et al. | |

FOREIGN PATENT DOCUMENTS

| | | |
|---|---|---|
| JP | 2001-100529 | 4/2001 |
| JP | 2010-217238 | 9/2010 |

* cited by examiner

*Primary Examiner* — Arlene Heredia
*Assistant Examiner* — Laura Roth
(74) *Attorney, Agent, or Firm* — Xsensus LLP

(57) ABSTRACT

A powder container case includes a first member, a second member, a main joint, and an additional joint. The first member and the second member are joined to form an edge portion of a case opening. The main joint is disposed between the first member and the second member, and has an end portion at the edge portion of the case opening. The additional joint is disposed adjacent to the end portion of the main joint.

16 Claims, 11 Drawing Sheets

POWDER CONTAINER, DEVELOPING DEVICE, AND IMAGE FORMING APPARATUS WITH MULTIPLE JOINTS TO PREVENT LEAKAGE

CROSS-REFERENCE TO RELATED APPLICATION

This patent application is based on and claims priority pursuant to 35 U.S.C. § 119(a) to Japanese Patent Application No. 2020-133259, filed on Aug. 5, 2020, in the Japan Patent Office, the entire disclosure of which is incorporated by reference herein.

BACKGROUND

Technical Field

Aspects of the present disclosure relate to a powder container, a developing device, and an image forming apparatus.

Related Art

Conventionally, a powder container is known that a first member and a second member are bonded to form an edge portion of case opening. For example, a developing device is known in which a developing roller is partially exposed from a case opening in a powder storage case.

SUMMARY

In an aspect of the present disclosure, there is provided a powder container case that includes a first member, a second member, a main joint, and an additional joint. The first member and the second member are joined to form an edge portion of a case opening. The main joint is disposed between the first member and the second member, and has an end portion at the edge portion of the case opening. The additional joint is disposed adjacent to the end portion of the main joint.

In another aspect of the present disclosure, there is provided a developing device that includes a developer bearer and the powder container case. The developer bearer is disposed in the powder container case such that a portion of the developer bearer is exposed from the case opening to outside of the powder container case.

In still another aspect of the present disclosure, there is provided a developing device that includes a developer bearer, a powder container case, a thickness regulator, and a doctor mount. The thickness regulator regulates a layer of developer and is disposed with a gap from the developer bearer. The thickness regulator is mounted on the doctor mount. The powder container case includes a case opening, a lower case, an upper cover, a main welding, a seal, and an additional welding. The lower case and the upper cover are joined to form the case opening and a surface around the case opening. The main welding is disposed between the lower case and the upper cover, and has an edge adjacent to the surface of the case opening. The seal is disposed on the surface and covers the edge of the main welding. The additional welding branches from the main welding, and the edge of the additional welding is covered by the seal. The lower case includes a lower case opening that opens in a direction different from a direction in which the case opening opens, and the lower case opening shares one side with the case opening. The upper cover covers the lower case opening. The lower case further includes a pair of positioning bosses and a pair of screw holes. The pair of positioning bosses position the doctor mount. Each one of the pair of positioning bosses is disposed at a position closer to a longitudinal end of the lower case than the lower case opening. Screws are fitted to the pair of screw holes to fix the gap. Each one of the pair of screw holes is disposed at a position closer to the longitudinal end of the lower case than corresponding one of the pair of positioning bosses. A surface of the lower case on which the pair of screw holes are disposed protrudes by a certain amount beyond a surface of the lower case on which the pair of positioning bosses are disposed. The certain amount is smaller than a thickness of the seal.

In still yet another aspect of the present disclosure, there is provided a developing device that includes a developer bearer, a powder container case, a thickness regulator, and a doctor mount. The thickness regulator regulates a layer of developer and is disposed with a gap from the developer bearer. The thickness regulator is mounted on the doctor mount. The powder container case includes a case opening, a lower case, an upper cover, a welding, and a seal. The lower case and the upper cover are joined to form the case opening and a surface around the case opening. The welding is disposed between the lower case and the upper cover and has an end part adjacent to the surface of the case opening. The seal is disposed on the surface and covers the end part of the welding. The end part of the welding extends along the surface. The lower case includes a lower case opening that opens in a direction different from a direction in which the case opening opens. The lower case opening shares one side with the case opening. The upper cover covers the lower case opening. The lower case further includes a pair of positioning bosses and a pair of screw holes. The pair of positioning bosses position the doctor mount. Each one of the pair of positioning bosses is disposed at a position closer to a longitudinal end of the lower case than the lower case opening. Screws are fitted to the pair of screw holes to fix the gap. Each one of the pair of screw holes is disposed at a position closer to the longitudinal end of the lower case than corresponding one of the pair of positioning bosses. A surface of the lower case on which the pair of screw holes are disposed protrudes by a certain amount beyond a surface of the lower case on which the pair of positioning bosses are disposed. The certain amount is smaller than a thickness of the seal.

In still yet further another aspect of the present disclosure, there is provided an image forming apparatus that includes the developing device according to any one of the above-described aspects.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
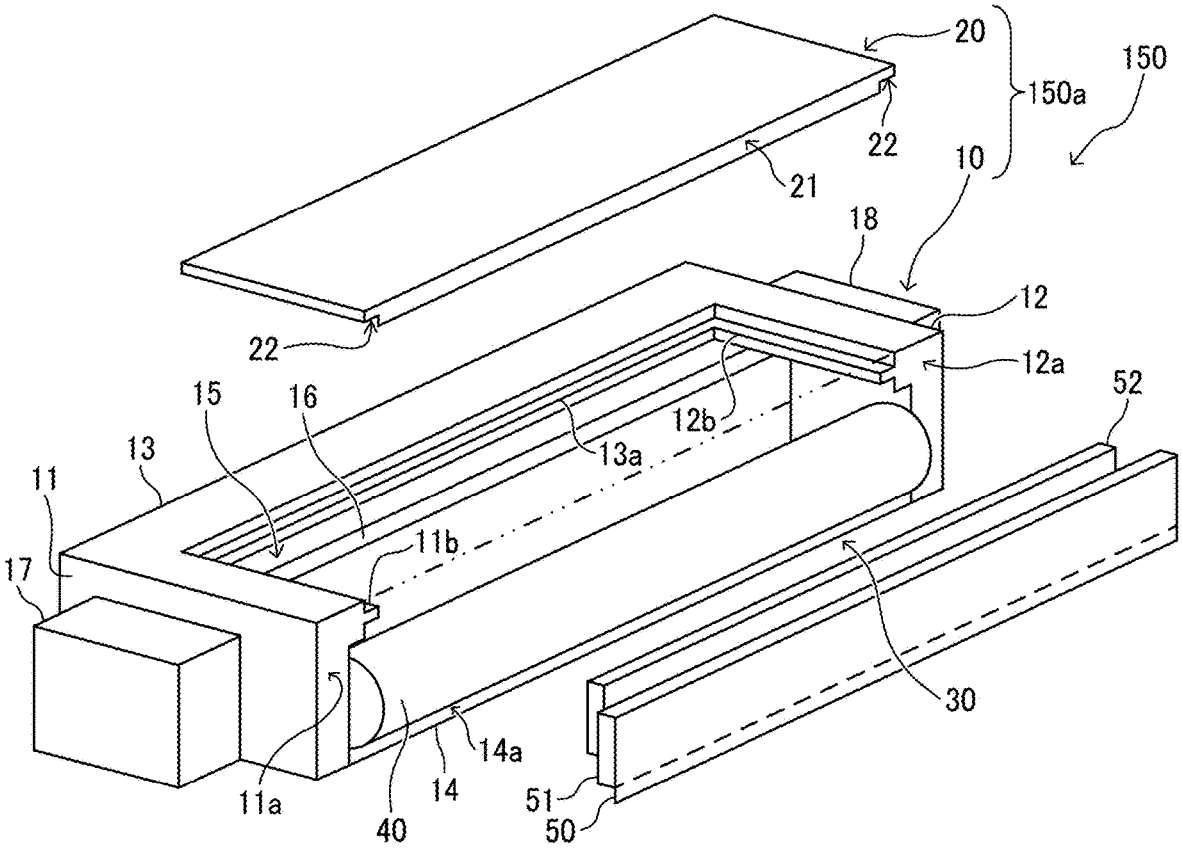
FIG. 1 is an exploded perspective view of a developing device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of a developing device, according to an embodiment of the present disclosure, including a developing roller serving as a developer bearer such that the developing roller is partially exposed from a case opening in a powder storage case. FIG. 1 is an exploded perspective view of a developing device 150 according to an embodiment of the present disclosure. A developing case 150*a* (serving as a powder storage case) includes a lower case 10 (serving as a first member) and an upper cover 20 (serving as a second member).

The lower case 10 includes a first side plate 11, a second side plate 12, a back plate 13 (backward when viewed from a conveyance direction of an intermediate transfer belt), and a bottom plate 14. The lower case 10 does not include a front plate facing the back plate 13, and includes a developing case opening 30 serving as a case opening that exposes a part of a developing roller 40. Further, the lower case 10 includes a lower-case upper opening 15 that is open on the upper side in the FIG. 1. The lower-case upper opening 15 communicates with a top edge of the developing case opening 30. That is, the lower-case upper opening 15 shares one edge with the developing case opening 30 and corresponds to a first-member opening that opens upward, which is a different direction from a direction in which the developing case opening 30 opens, in FIG. 1.

The lower case 10 has a partition plate 16 inside extending parallel to the developing roller 40. The lower case 10 includes a pair of stirring members in spaces partitioned by the partition plate 16 described below. The width of each one of the pair of stirring members is wider than the width of the developing roller 40. The lower case 10 includes a first circulation case 17 and a second circulation case 18 to accommodate both ends of the pair of stirring members in the width direction of the pair of stirring members. The first circulation case 17 forms a communicating portion without the partition plate 16.

Each of the plate 11, 12, and 13 is disposed on. A cover mounting portion 11*b*, a cover mounting portion 12*b*, and a cover mounting portion 13*a* protrude from inner surfaces of the first side plate 11, the second side plate 12, and the back plate 13, respectively, inward of the lower-case upper opening 15 in the lower case 10. An inner edge of each of the cover mounting portion 11*b*, the cover mounting portion 12*b*, and the cover mounting portion 13*a* constitutes an edge of the lower-case upper opening 15. The upper cover 20 covers the lower-case upper opening 15 such that a peripheral portion of three edges of a lower surface of the upper cover 20 is mounted on the cover mounting portions 11*b*, 12*b*, and 13*a*.

Figure 2:
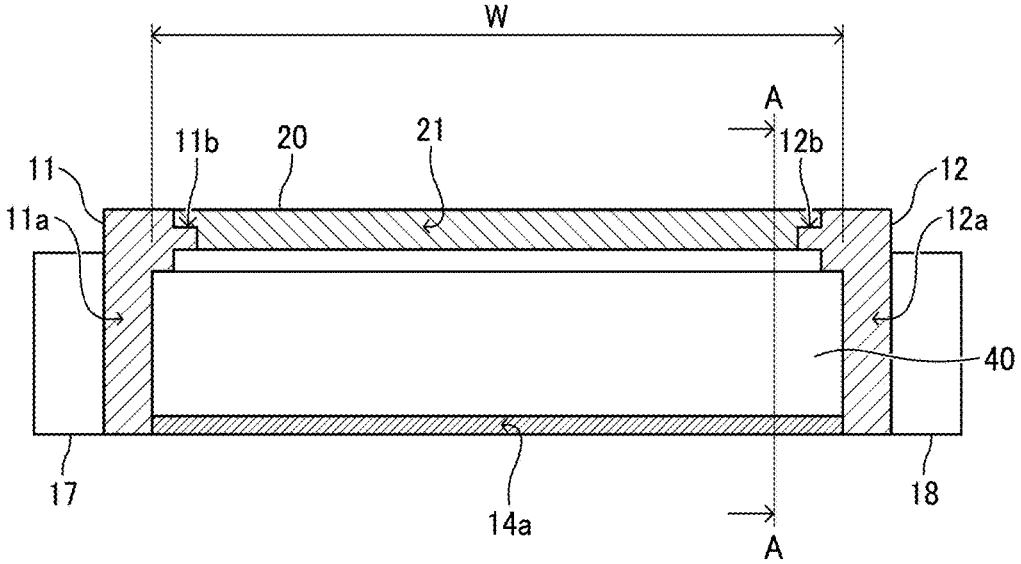
FIG. 2 is a front view of a developing case of the developing device of FIG. 1.

Thus, when the upper cover 20 is mounted, an upper-cover opening end face 21 constitutes an edge portion of the developing case opening 30 together with a first-side-plate opening end face 11*a*, a second-side-plate opening end face 12*a*, and a bottom-plate opening end face 14*a* of the lower case 10. FIG. 2 is a schematic view of the developing case 150*a* seen from a side of the developing case opening 30. Hatching is drawn on the end faces 21, 11*a*, 12*a*, and 14*a* constituting the edge portion in FIG. 2. That is, the lower case 10 and the upper cover 20 constitute the edge portion of the developing case opening 30 as a case opening. The upper cover 20 is joined to the lower case 10 so as to fix such a state, with a joining method described later.

Figure 3:
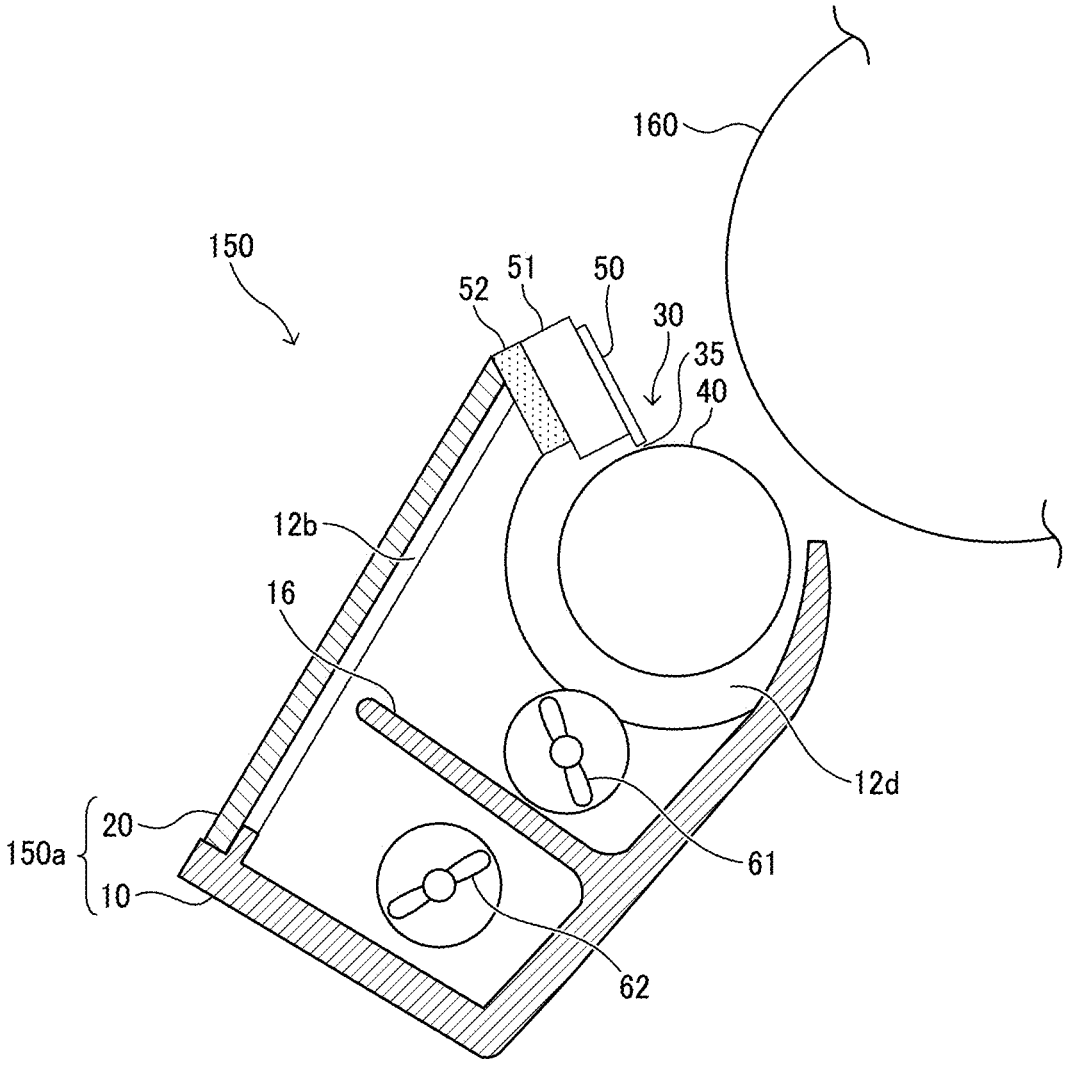
FIG. 3 is a cross-sectional diagram illustrating a state in which the developing case of FIG. 2 attached.

Returning to FIG. 1, after the upper cover 20 is joined to the lower case 10, a doctor 50 fixed to a doctor mount 51 and made of, e.g., metal is attached to the lower case 10 so as to cover the developing case opening 30, sandwiching a seal 52 such as a sponge seal with the upper cover 20. FIG. 3 is a cross-sectional diagram illustrating a state in which the above-described members are attached to the lower case 10 in FIG. 1. The position of the cross-section of FIG. 3 is along a line A-A in FIG. 2. The seal 52 covers end faces at which a contact portion between the cover mounting portion 12*b* of the second side plate 12 and the lower surface of the upper cover 20 contacting the cover mounting portion 12*b* is exposed, and contacts the lower case 10 and the upper cover 20. Similarly for the opposite side (the side of the cover mounting portion 11*b*) of the cross-section, the seal 52 covers end faces at which a contact portion between the cover mounting portion 11*b* of the first side plate 11 and the lower surface of the upper cover 20 is exposed, and contacts the lower case 10 and the upper cover 20. The seal 52 has a width indicated by W in FIG. 2. The doctor 50 is disposed with a doctor gap 35 from the development roller 40, to regulate the thickness of developer.

FIG. 3 also indicates a first stirring member 61 and a second stirring member 62 disposed on both sides of the partition plate 16. A seal 12*d* is also disposed between a peripheral surface of the developing roller 40 and a facing portion of the second side plate 12 that faces the peripheral surface of the developing roller 40. The first side plate 11 has a similar configuration. The surface of the developing roller 40 exposed from the developing case opening 30 faces a photoconductor 160 as a latent image bearer.

Figure 4C:
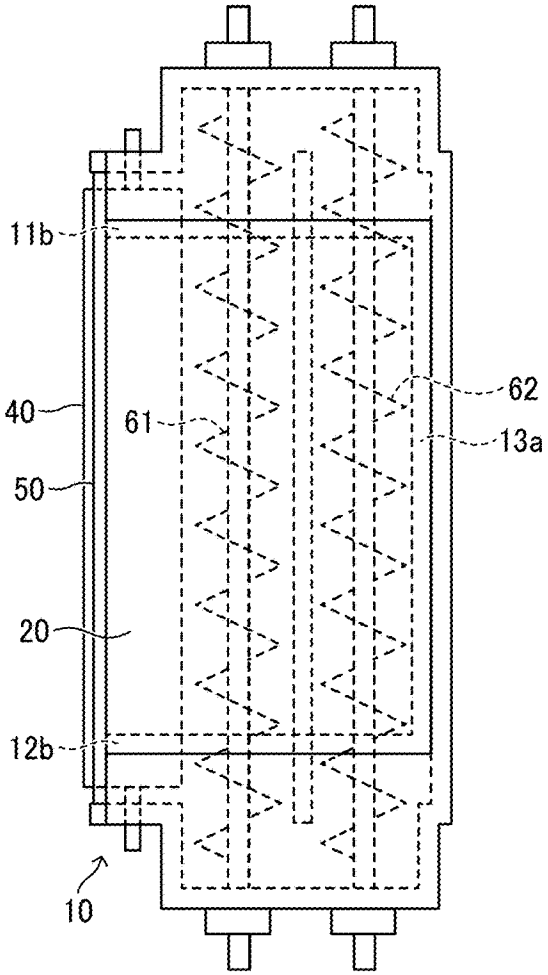
FIGS. 4A, 4B, and 4C are diagrams illustrating a process from joining of the developing case of FIG. 2 to attaching of a doctor.
Figure 4B:
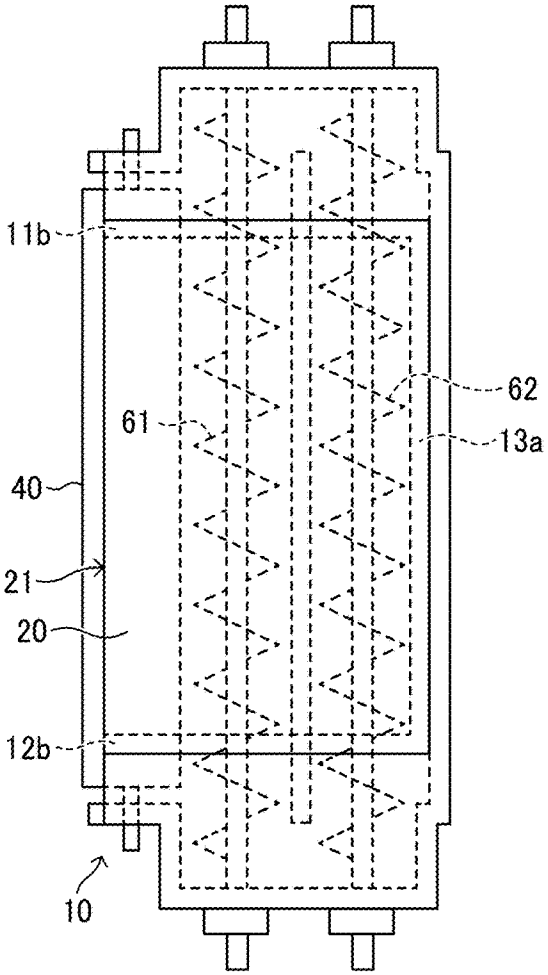
Figure 4A:
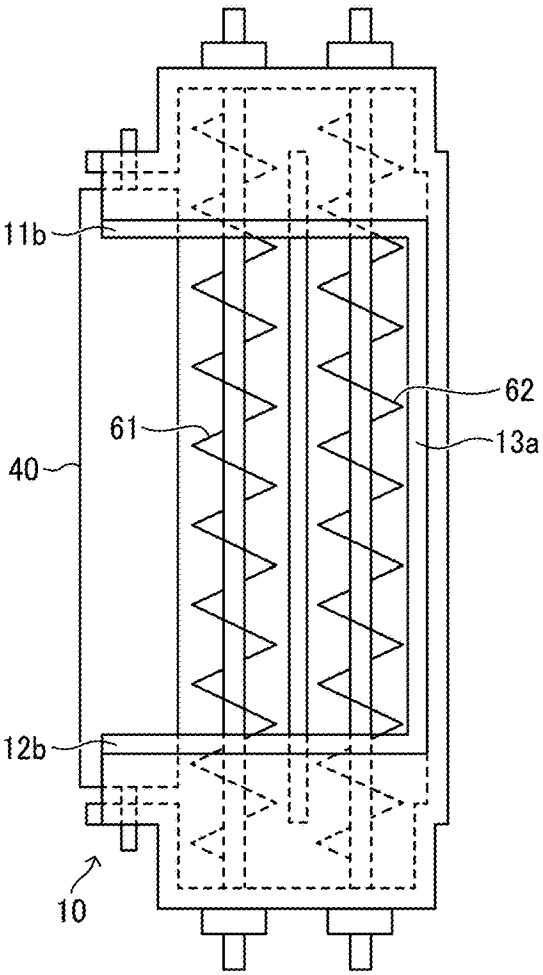

FIGS. 4A, 4B, and 4C are diagrams illustrating a process from joining of the upper cover 20 to attaching of the doctor 50 as a developer-layer thickness regulator. FIG. 4A is a plan view of the lower case 10 before attaching the upper cover 20. FIG. 4B is a plan view of the upper cover 20 bonded to the lower case 10. FIG. 4C is a schematic diagram illustrating a configuration in which an installation of the doctor mount 51 as developer layer thickness regulator is completed. The seal 52 (see FIGS. 1 and 3) is disposed between the doctor mount 51 and each of the cover mounting portions 11*b* and 12*b* of the lower case 10 and the upper cover 20. The doctor 50 may be attached without the doctor mount 51 in the case that a strength of the doctor 50 is sufficient. In this case, the seal 52 (see FIGS. 1 and 3) is disposed between the doctor 50 and each of the cover mounting portions 11*b* and 12*b* of the lower case 10 and the upper cover 20.

Figure 5A:
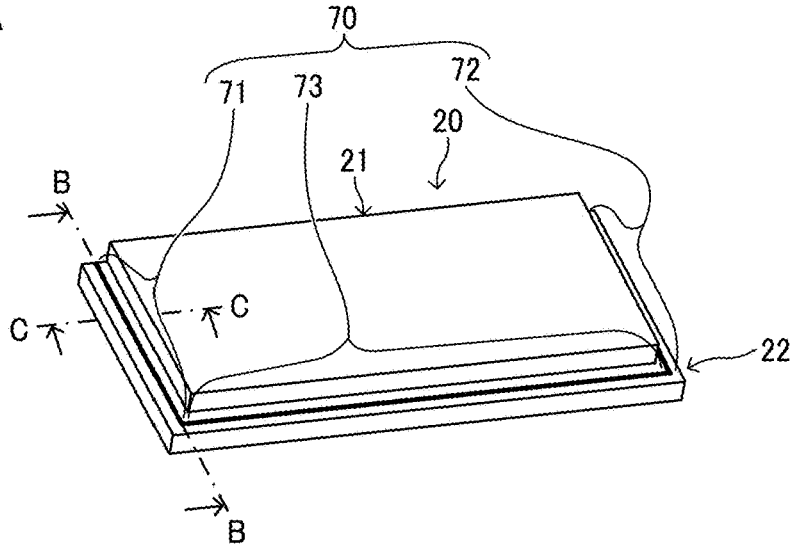
FIGS. 5A, 5B, 5C, 5D, 5E, and 5F are diagrams illustrating ultrasonic welding.
Figure 5B:
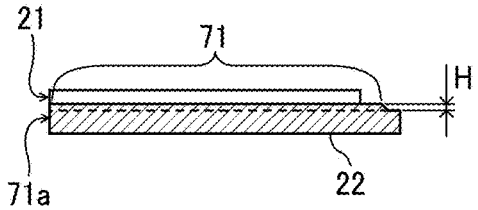
Figure 5C:
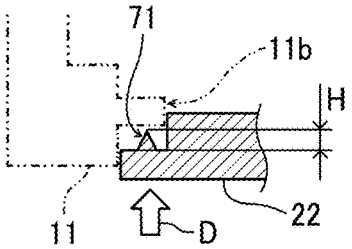

FIG. 5A is a perspective diagram illustrating a lower face side of the upper cover 20 before joining. In this example, a rib-shaped convex portion that is an energy director for ultrasonic welding is disposed on a ridge 70 along three edges of the lower case 10. Specifically, when the upper cover 20 is mounted on the cover mounting portions 11*b*, 12*b*, and 13*a* in the lower case 10, the ridge 70 is disposed on a mounting face 22 on the peripheral three edges that contact the cover mounting portions 11*b*, 12*b*, and 13*a*. The ridge 70 includes a first portion 71, a second portion 72, and a back portion 73 that connects ends of the first portion 71 and the second portion 72. FIG. 5B is a cross-sectional view of the upper cover 20 cut along line B-B in FIG. 5A. FIG. 5C is a cross-sectional view of the upper cover 20 cut along line C-C in FIG. 5A. The rib-shaped convex portion may be disposed on the cover mounting portions 11*b*, 12*b*, and 13*a* of the lower case 10, not on the upper cover 20.

As illustrated in FIG. 5C, the ridge 70 has a triangular shape having, for example, a height H in cross section orthogonal to the longitudinal direction. Ultrasonic vibration is applied in a state where the ridge 70 is disposed so as to contact the cover mounting portion 11*b* of the lower case 10 while pressure is applied in the direction indicated by arrow D in FIG. 5C. As a result, the ridge 70 is melted and welded. The ridge 70 may be disposed on the cover mounting portions 11*b*, 12*b*, and 13*a* of the lower case 10 instead of or in addition to being disposed on the upper cover 20.

Figure 5D:
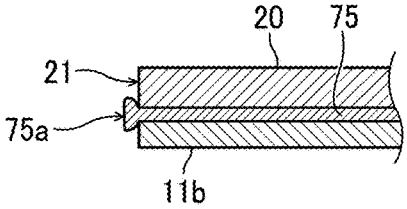
Figure 5E:
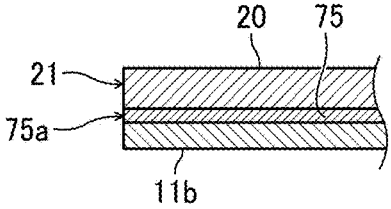
Figure 5F:
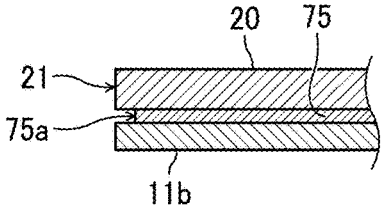

As illustrated in FIG. 5B, when an end portion 71*a* on the side of the upper-cover opening end face 21 of the ridge 70 is formed to a position corresponding to the upper-cover opening end face 21, an end portion 75*a* of a joint 75 (welding joint) formed by melting the ridge 70 protrudes beyond the upper-cover opening end face 21, as illustrated in FIG. 5D. When the protruding portion may deteriorate the sealing performance of the seal 52 illustrated in FIG. 3, deburring work is desirably performed. To avoid such deburring work, the following configurations are desirable. As illustrated in FIG. 5E, for example, the end portion 75*a* of the joint 75 aligns with the cover opening end face 21. Alternatively, ss illustrated in FIG. 5F, the end portion 75*a* of the joint 75 may take a retracted position, or the height of the ridge 70 at the end portion is lower than the height of other parts (reduce the amount of melting). The ridge 70 is formed so that the end portion 75*a* is disposed at the above-described position.

In the present embodiment, the joint 75 formed by the ridges 70 at three edges is disposed as a main joint in which the end portion 75*a* is positioned at the edge portion of the developing case opening 30. An additional joint between the lower case 10 and the upper cover 20 is disposed adjacent to the end portion 75*a*.

The reason for disposing such an additional joint is as follows. Assembling the case by thermal welding is preferable to ensure airtightness and to prevent variations due to automatic assembly. In assembly by thermal welding, if welding is performed without burrs due to the protrusion of the melting portion in consideration of variations in unit dimensions, sufficient adhesion to the edge portion may not be performed because the adhesion is difficult at the end point. Accordingly, a gap may be generated in the end portion (between the joint 75 and the seal). When the developing device 150 is tilted, developer in the developing case 150*a* might leak. The leakage of the developer is likely to occur at the end portion. For this reason, an additional joint is disposed adjacent to the end portion 75*a* of the main joint 75 positioned at the edge portion of the developing case opening 30 to reduce the probability of leakage of the developer. When one joint causes a gap that leaks the developer to the outside of the developing device 150 with a probability of 1%, increasing the number of joints to two can reduce the probability of leakage of the developer to the outside of the developing device 150 to 0.01%. The second joint is necessary to prevent only a small amount of developer having leaked at the first joint. Thus, developer pressure is almost unchanged and the probability of the leakage of the developer can be reduced to 0.01% or less.

Figure 6A:
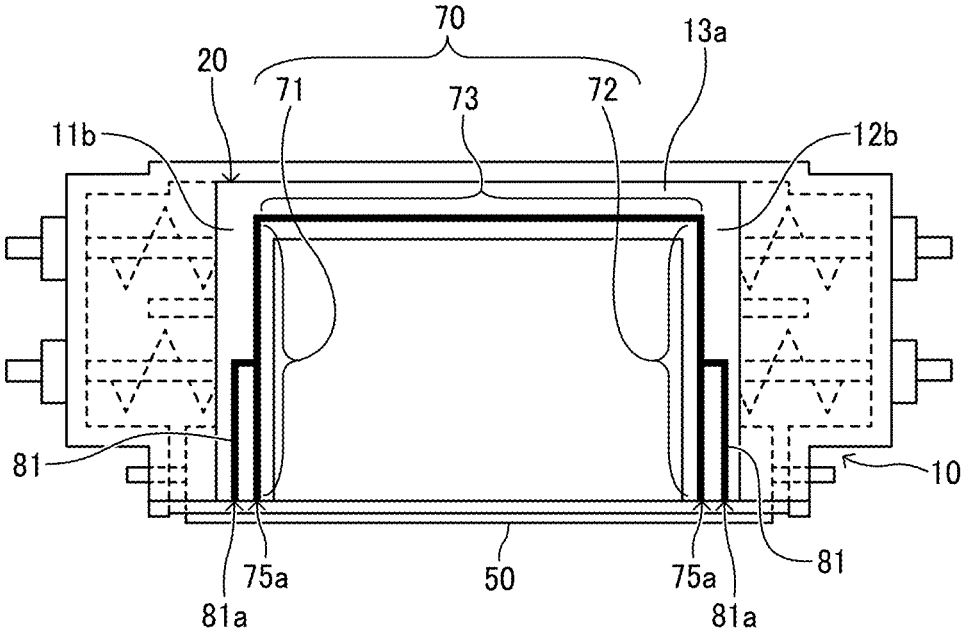
FIGS. 6A and 6B are diagrams illustrating a configuration example of an additional joint.
Figure 6B:
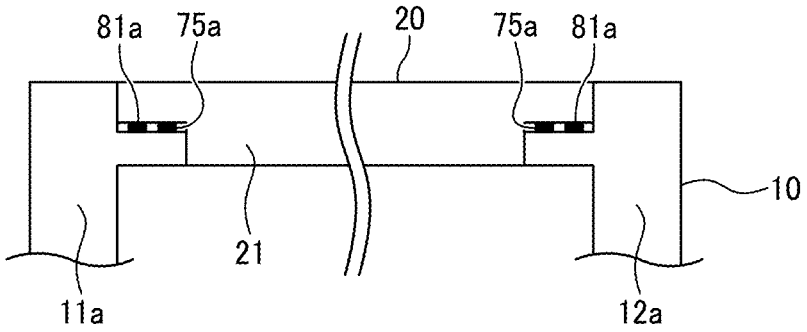

FIGS. 6A and 6B are diagrams illustrating a first configuration example of the additional joint. FIG. 6A is a plan view corresponding to FIG. 4C. The cover mounting portions 11*b*, 12*b*, and 13*a* are illustrated broadly in FIG. 6A, and the outline of ridges is illustrated by a solid line. The main joints are indicated by the numeral sign of the original ridge 70. In this configuration example, additional branch ridges 81 branch and extend from different points from end portions 75*a* in the ridge 70 constituting a main adjusting portion. FIG. 6B is a diagram illustrating a configuration example of an edge portion of the developing case opening 30 of the developing case 150*a* before the seal 52 and the doctor 50 are attached. As illustrated in FIG. 6B, at this edge portion, end portions 81*a* of the additional branch ridges 81 are disposed at positions different from the end portions 75*a* of the main joint.

Figure 7A:
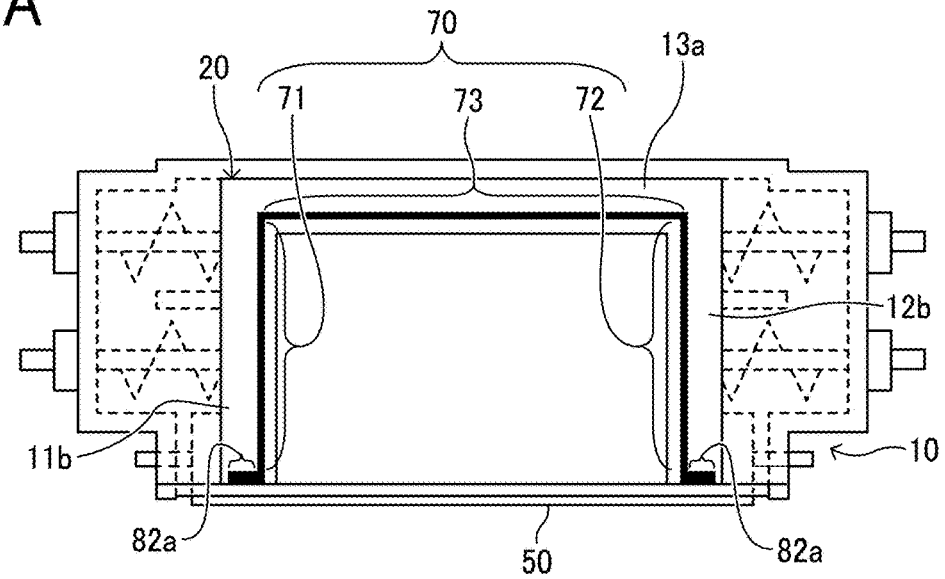
FIGS. 7A, 7B, 7C, and 7D are diagrams illustrating a configuration example of an additional joint.
Figure 7B:
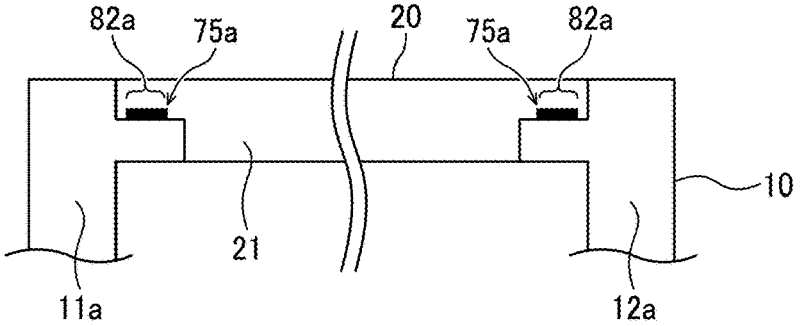
Figure 7C:
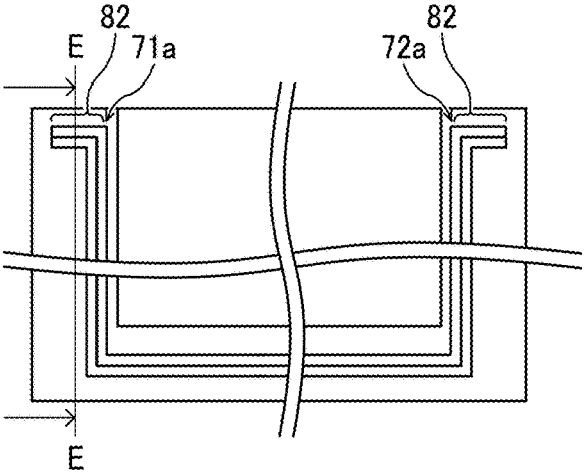
Figure 7D:
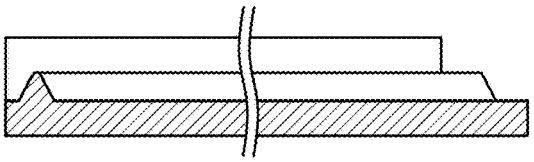

FIGS. 7A, 7B, 7C, and 7D are diagrams illustrating another configuration example of the additional joint. FIG. 7A is a plan view corresponding to FIG. 6A. The additional joint of this configuration example is a parallel additional ridge 82 formed so as to extend parallel to the edge portion of the developing case opening 30. FIG. 7B is a plan view corresponding to FIG. 6B. As illustrated in FIG. 7B, an end portion 82*a* of the parallel additional ridge 82 extends in the width direction along the joint face continuous to the end portion 75*a* of the main joint. FIG. 7C is a plan view of a lower surface of the upper cover 20 before joining. FIG. 7D is a cross sectional view of the upper cover 28 taken along line E-E of FIG. 7C.

Figure 8:
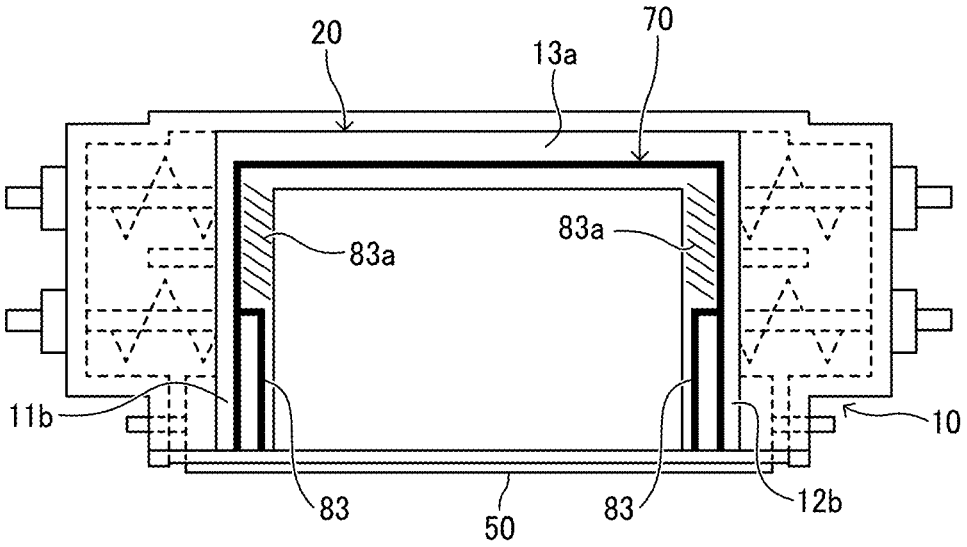
FIG. 8 is a diagram illustrating a configuration example of an additional joint.

In each of the above-described configuration examples, the additional joint is disposed at a position farther from the edges of the lower-case upper opening 15 (in other words, the inner edges of the cover mounting portions 11*b*, 12*b*, and 13*a*) than the ridge 70 constituting the main adjusting portion is. In contrast, in FIG. 8, an example is illustrated in which an additional joint is disposed at a position closer to the edges of the lower-case upper opening 15 than the ridge 70 constituting the main adjusting portion is. The illustrated example in FIG. 8 is an example of an additional branch ridge 83. With the above-described configuration, the effect of preventing toner leakage can be expected. A dead space is generated at a gap between the upper surface of each of the cover mounting portions 11*b*, 12*b*, and 13*a* of the lower case 10 and the lower face of the upper cover 20. A powder (toner) that enters the gap (hatching areas in FIG. 8) may be stuck in an immovable state. Such toner entering the gap may agglomerate, which might affect an image. The arrangement of the configuration examples of FIGS. 6A, 6B, 7A, 7B, 7C, and 7D is preferable from the viewpoint of not causing such a dead space.

In the developing case 150*a*, as illustrated in FIG. 5E, the positions of the end portion of the joint and the edge of the developing case opening 30 do not need to align exactly. For example, a position where the end portion of the joint is visible from between the lower case 10 and the upper cover 20 joined is sufficient. In such a case, visual inspection is performed with a seal member removed.

Figure 9:
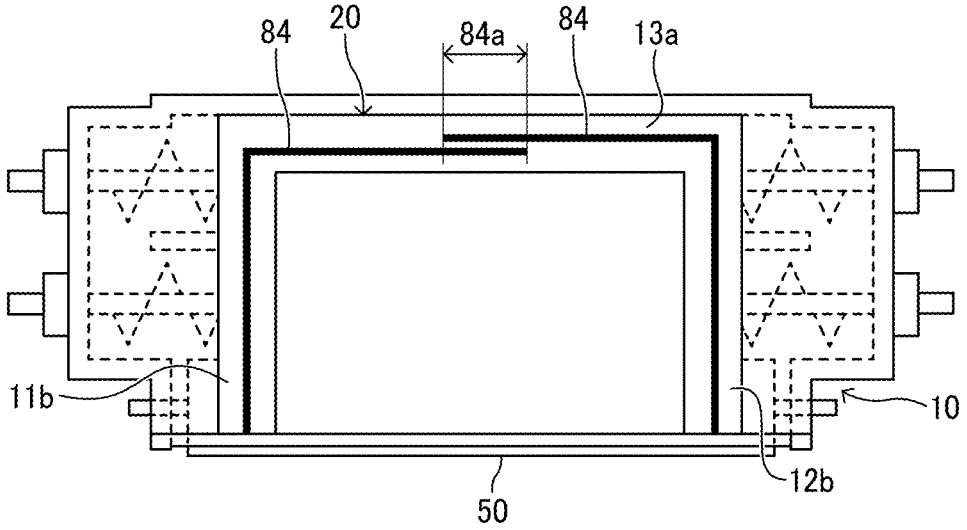
FIG. 9 is a diagram illustrating a variation.

FIG. 9 is a diagram illustrating a variation. In the variation, the lower case 10 shares an edge with the developing case opening 30. The developing case 150*a* includes the lower-case upper opening 15 with a different-angled opening face. The upper cover 20 is disposed so as to cover the lower-case upper opening 15. The basic configuration is substantially the same as the configuration examples illustrated in FIGS. 6A, 6*b*, 7A, 7B, 7C, and 7D. One difference is that the ridge 70 constituting the main adjusting portion is made up of the following pair of linear joints 84. One end of each of the joints is located at an edge portion of each of both ends of the developing case opening 30. The joints 84 are a pair of linear joints that turn around different sides (the cover mounting portion 11*b* side and the cover mounting portion 12*b*) of the lower-case upper opening 15 and extend along the cover mounting portion 13*a*. At a center of an edge (the edge on the cover mounting portion 13*a*) facing one edge, the joints 84 are disposed so that the other end of one joint overlaps the other end of the other joint by a specified amount 84*a*.

In the variation, U-shape is made with a combination of L-shapes, and end points of the L-shapes are overlapped, thus preventing an occurrence of a gap. In this variation, the end portion is disposed at the edge portion of the developing case opening 30. Further, disposing an additional joint as illustrated in FIGS. 6A, 6B, 7A, 7B, 7C, and 7D is preferable.

Figure 10:
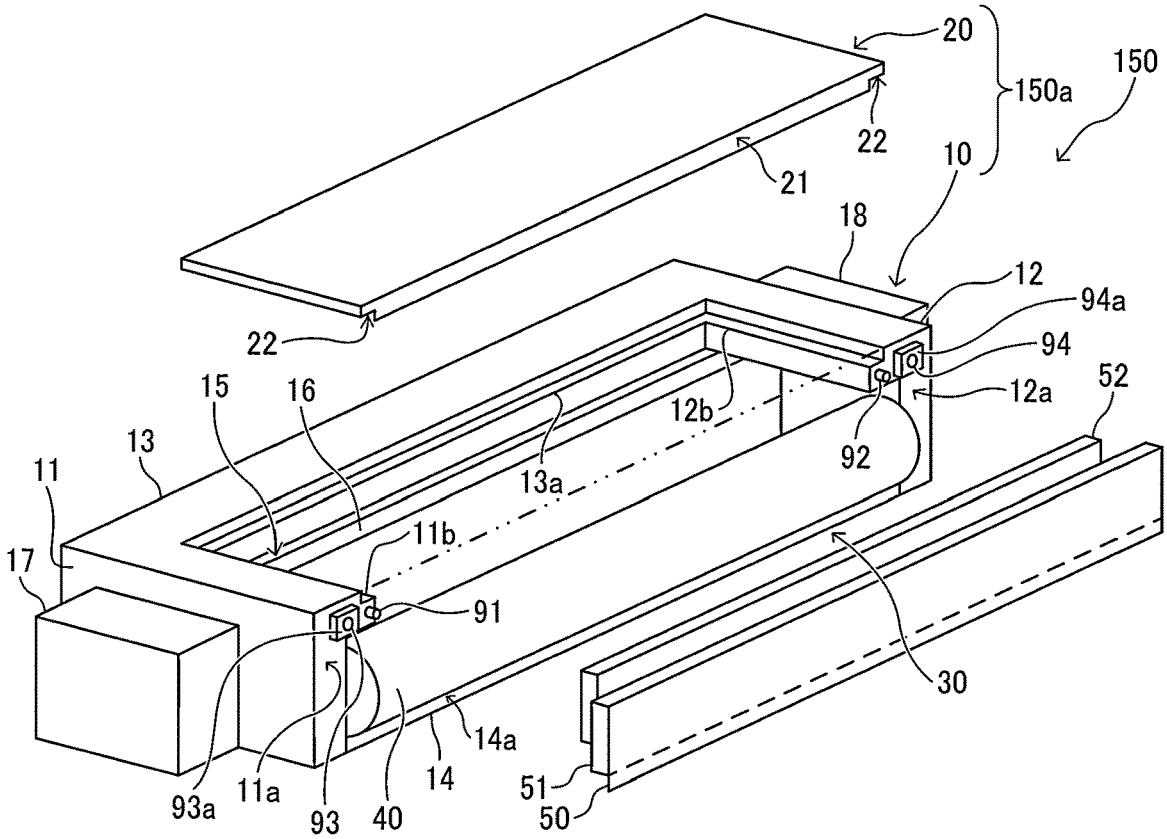
FIG. 10 is an exploded perspective view of details of the developing device of FIG. 1.

FIG. 10 is a perspective view illustrating details of the developing device 150 in FIG. 1. Details are described below while changing expressions. The developer storage case of the developing device 150 having a plurality of developer conveyance passages partitioned by the partition plate 16 includes a plurality of parts including the lower case 10 and the upper cover 20. The lower case 10 includes a substantially U-shaped opening formed such that the plurality of developer conveyance passages are exposed. The upper cover 20 is formed so as to be attached to the substantially U-shaped opening of the lower case 10. The lower case 10 and the upper cover 20 are fixed by welding each other at the substantially U-shaped welding portion outside the substantially U-shaped opening. The welding portion is exposed to be visible between the lower case 10 and the upper cover 20 from the substantially U-shaped tip portion. The seal 52 contacts from the lower case 10 to the upper cover 20 in an area including the substantially U-shaped tip portion.

In the case of the configuration illustrated in FIGS. 6A and 6B, the welding portion is visible from the substantially U-shaped tip portion. In the case of the configuration illustrated in FIGS. 7A to 7D, the welding portion visible from the substantially U-shaped tip portion having extends in the longitudinal direction. The lower case 10 includes positioning bosses 91 and 92 for positioning the doctor mount 51 to a face to which the doctor mount 51 is attached via the seal 52 at positions of the cover mounting portions 11*b* and 12*b* in the longitudinal direction. The positioning bosses 91 and 92 correspond to a pair of positioning portions.

The seal 52 has holes at positions corresponding to the positioning bosses 91 and 92, and the seal 52 is also positioned by fitting the holes in the positioning bosses 91 and 92. After welding the lower case 10 and the upper cover 20, the seal 52 is attached to and fixed to the upper cover 20 with a double-sided adhesive tape. The double-sided adhesive tape is not attached at the positions of the cover mounting portions 11*b* and 12*b* at both end portions of the upper cover 20. Without a double-sided adhesive tape, the joint between lower case 10 and upper cover 20 faces the seal 52 (instead of the double-sided adhesive tape). Thus, a gap is less likely to occur. The seal 52 is made of a sponge, because a gap is covered so that the sponge deforms and follows the gap (in the case where the gap of the joint is quite small) when the doctor mount 51 is attached.

Two screw holes 93 and 94 to fix the doctor mount 51 are disposed outside of the cover mounting portions 11*b* and 12*b* of the lower case 10 (or on longitudinal end portions of the lower case 10). The two screw holes 93 and 94 correspond to a pair of screw holes. The two screw holes 93 and 94 at both ends and the two positioning bosses 91 and 92 are located substantially on a straight line in the longitudinal direction. Doctor-mount mounting faces 93*a* and 94*a* having screw holes 93 and 94 are formed at higher positions with a height difference than a surface including the tip end of the joint of the lower case 10 and upper cover 20. With such a configuration, if a molten portion protrudes from the joint toward the doctor mount 51, the doctor mount 51 does not sandwich the molten portion. The doctor mount 51 can be mounted with high accuracy.

One end of the seal 52 is disposed between the positioning boss 91 and the doctor-mount mounting face 93*a*. The other end of the seal 52 is disposed between the positioning boss 92 and the doctor-mount mounting face 94*a*. With such a configuration, the seal 52 is not sandwiched between the doctor mount 51 and the lower case 10. The doctor mount 51 can be mounted with high accuracy. As described above, the seal 52 is attached to the positioning bosses 91 and 92 and positioned at both ends. Even if a tolerance of the seal 52 varies, the seal 52 does not run on the doctor-mount mounting faces 93*a* and 94*a*. The height difference is set smaller than the thickness of the sponge as the seal 52. The sponge is compressed by a specified amount between the doctor mount 51 and each of the lower case 10 and the upper cover 20 to achieve sealability.

Figure 11:
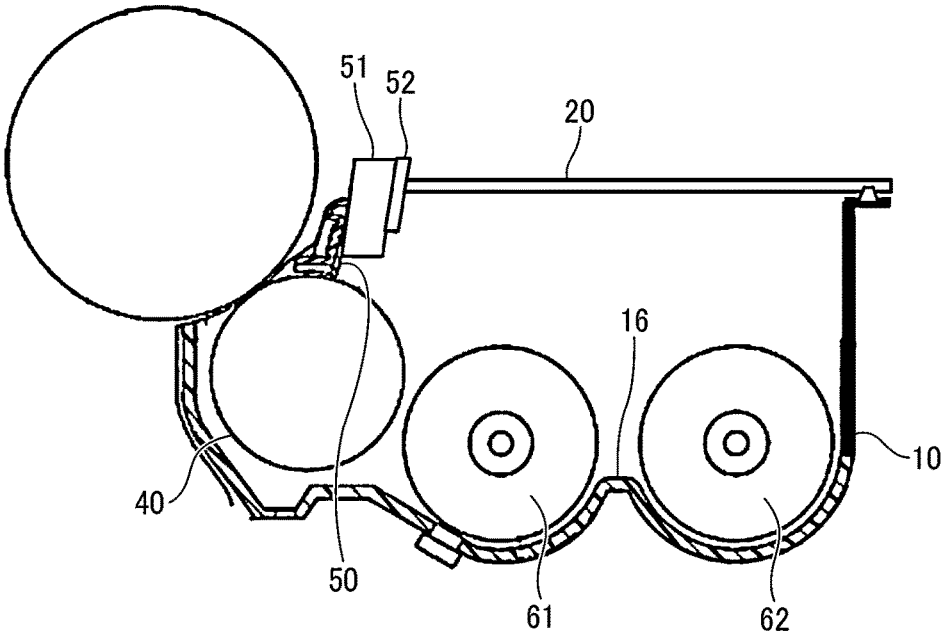
FIG. 11 is a cross-sectional view of a variation of the developing device.
Figure 12C:
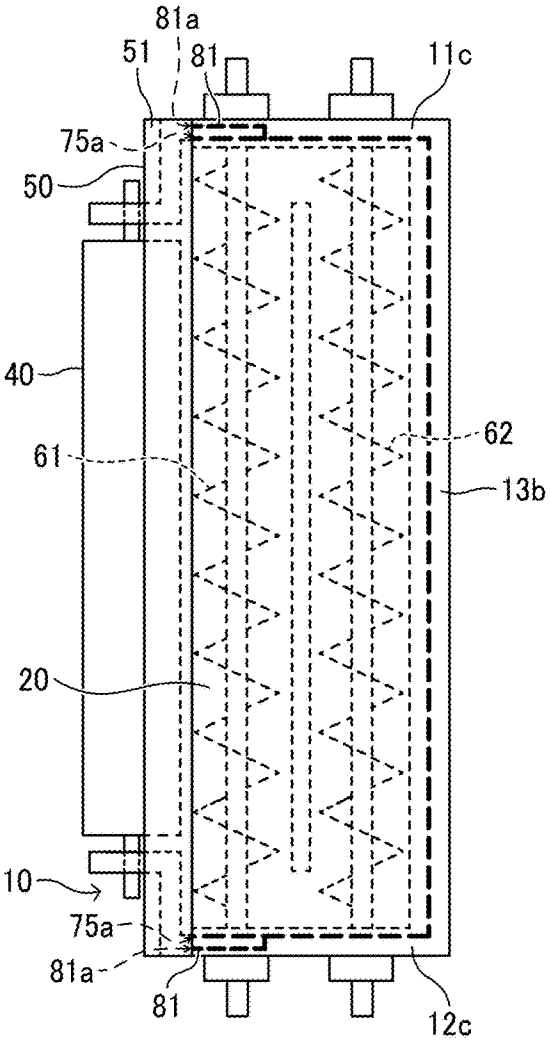
FIGS. 12A, 12B, and 12C are diagrams illustrating a process from joining of the developing case to attaching of the doctor.
Figure 12B:
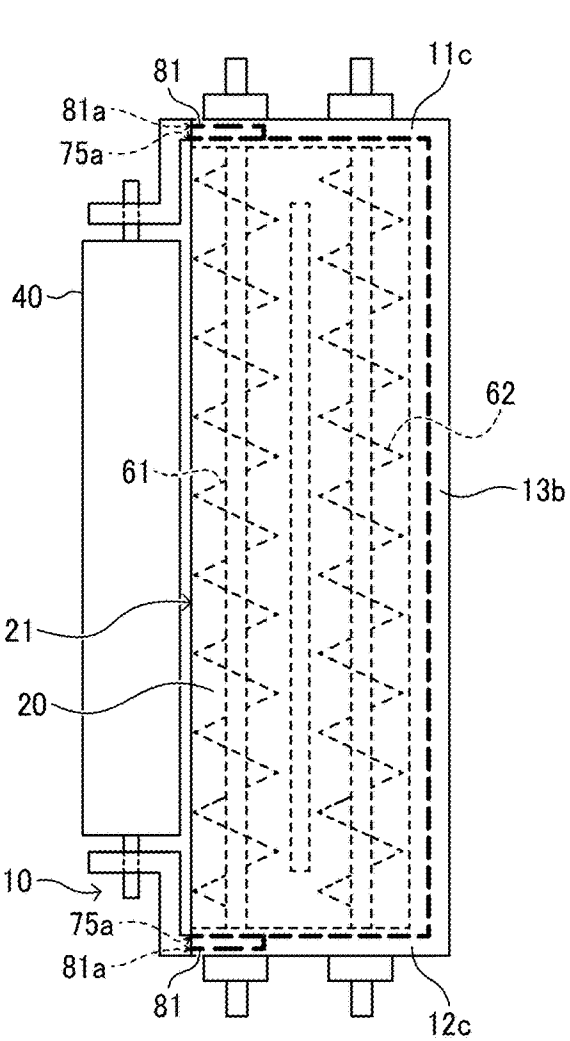
Figure 12A:
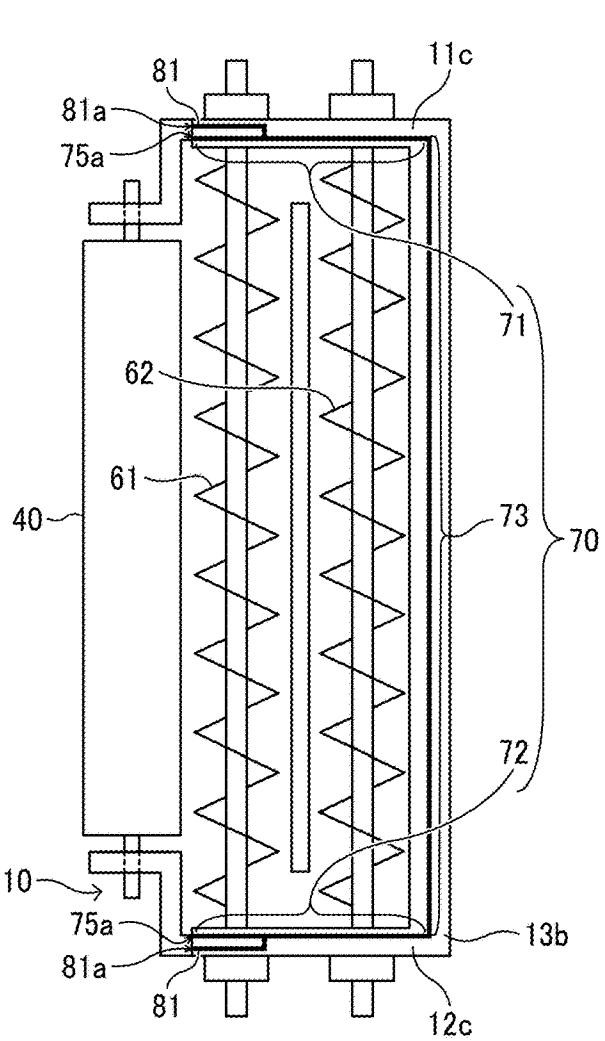

FIG. 11 is a cross-sectional view of a developing device 150 according to a variation. FIGS. 12A, 12B, and 12C are diagrams illustrating a process from joining of a developing case 150*a* to attaching of a doctor 50 of the developing device 150 illustrated in FIG. 11. FIGS. 12A, 12B, and 12C correspond to the processes of FIGS. 4A, 4B, and 4C. The developing device 150 according to the variation, as illustrated in FIG. 12A, a first side plate 11 and a second side plate 12 are at positions to support both ends of a first stirring member 61 and a second stirring member 62. An upper surface 11*c* of the first side plate 11, an upper surface 12*c* of the second side plate 12, and an upper surface 13*b* of a back plate 13 are mounting faces of an upper cover 20.

As illustrated in FIG. 12A, additional joints similar to the additional joints illustrated in FIG. 6A. That is, additional branch ridges 81 are disposed that branch and extend from different points from end portions 75*a* of ridges 70 constituting a main adjusting portion. In an edge portion of a developing case opening 30 of the developing case 150*a* before a seal 52 or a doctor 50 is attached, end portions 81*a* of additional branch ridges 81 are disposed at positions different from the end portions 75*a* of the main adjusting portion.

Figure 13C:
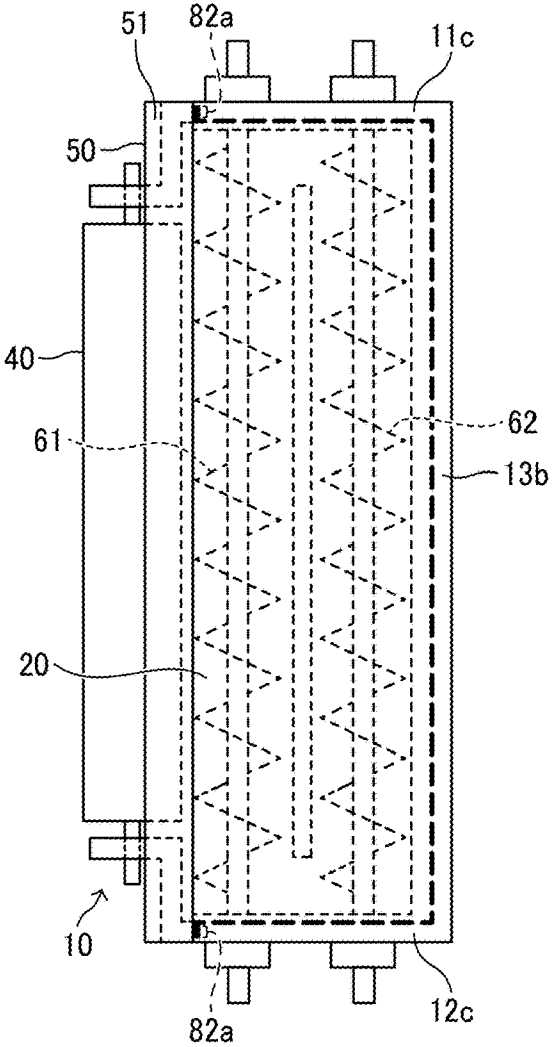
FIGS. 13A, 13B, and 13C are diagrams illustrating a variation of the process from joining of the developing case to attaching of the doctor.
Figure 13B:
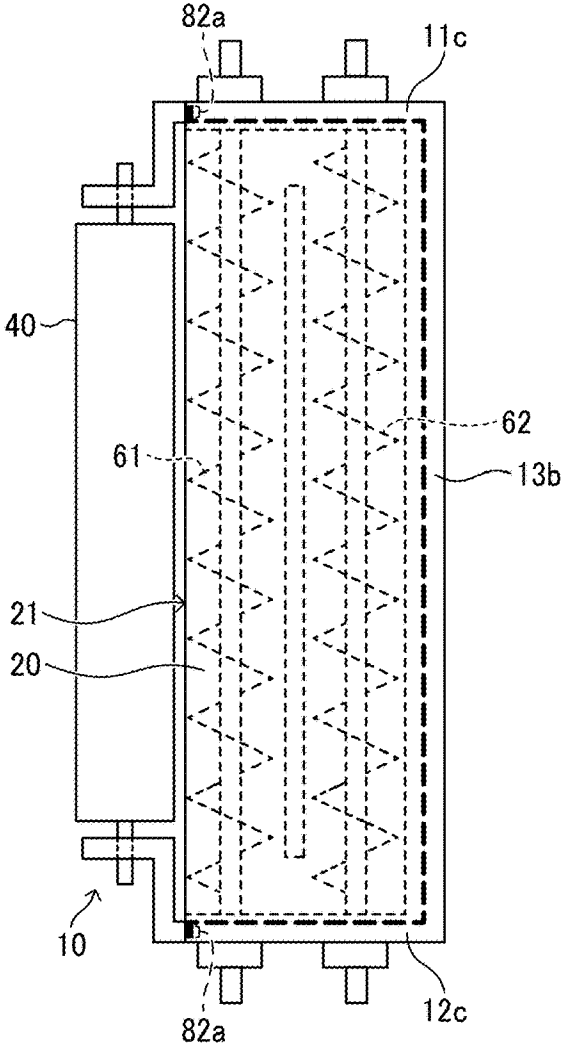
Figure 13A:
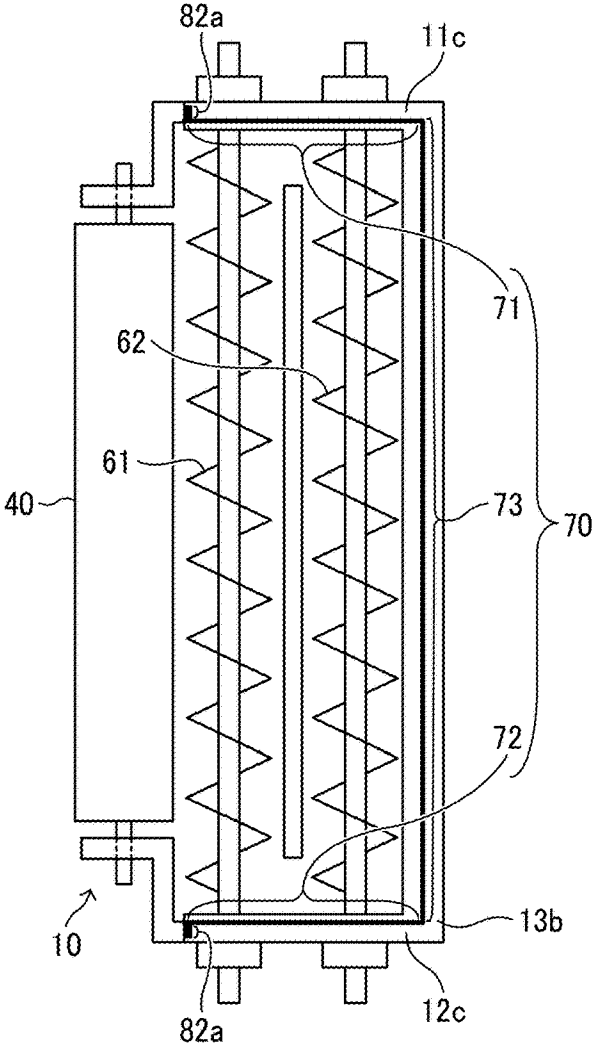

FIGS. 13A, 13B, and 13C illustrate a variation including additional joints similar to the additional joints illustrated in FIGS. 7A to 7D. The additional joints of this variation are parallel additional ridges 82 extend parallel to the edge portion of the developing case opening 30. FIGS. 13A, 13B, and 13C correspond to the processes of FIGS. 12A, 12B, and 12C. As illustrated in FIG. 13A, an end portion 82*a* of each parallel additional ridge 82 extends in the width direction along a joint face continuous to an end portion 75*a* of the main joint.

Figure 14:
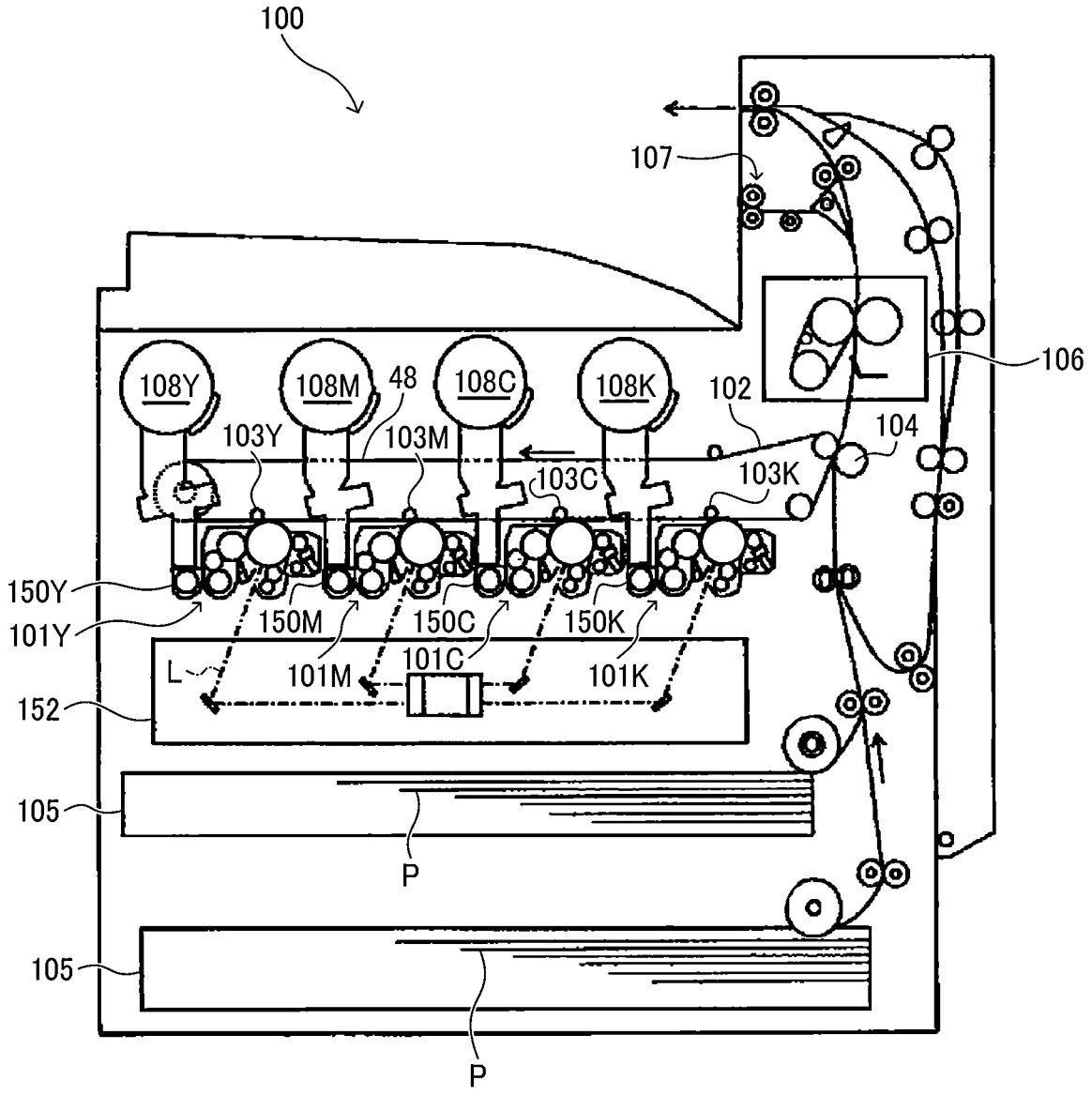
FIG. 14 is a schematic diagram illustrating a configuration of an image forming apparatus according to an embodiment of the present disclosure.

FIG. 14 is a schematic diagram illustrating a configuration of an image forming apparatus 100 according to an embodiment of the present disclosure. The image forming apparatus 100 includes the developing device 150 including the above-described developing case 150*a*. The image forming apparatus 100 includes four image forming units 101Y, 101M, 101C, and 101K that include four developing devices 150Y, 150M, 150C, and 150K, respectively, which can be used simultaneously for image formation. Each of the four image forming units 101Y, 101M, 101C, and 101K includes, e.g., a photoconductor and a cleaning device in addition to the developing device 150. The image forming apparatus 100 includes a writing unit 152 below the four image forming units 101Y, 101M, 101C, and 101K. The developing devices 150Y, 150M, 150C, and 150K develop latent images formed on the photoconductors by optical writing of the writing unit 152, to form toner images of colors of yellow, magenta, cyan and black (hereinafter abbreviated as Y, M, C and K).

The image forming apparatus 100 includes an intermediate transfer belt 102 as an intermediate transferor above the four image forming units 101Y, 101M, 101C, and 101K. The image forming apparatus 100 includes primary transfer members 103Y, 103M, 103C, and 103K at positions inside a loop of the intermediate transfer belt 102 corresponding to the image forming units 101Y, 101M, 101C, and 101K. The image forming apparatus 100 includes a secondary transfer device 104 facing the surface of the intermediate transfer belt 102. The image forming apparatus 100 includes a sheet feeder 105, a fixing device 106, and an output roller pair 107. The sheet feeder 105 feeds a printing sheet between the intermediate transfer belt 102 and the secondary transfer device 104. The fixing device 106 fixes a toner image on the printing sheet on which the toner image is transferred from the intermediate transfer belt 102 by the secondary transfer device 104. The output roller pair 107 ejects the printing sheet on which the toner image is transferred toward the outside of the image forming apparatus 100.

Toner bottles 108Y, 108M, 108C, and 108K as toner containers are disposed upper portion of the image forming apparatus 100. The toner bottles 108Y, 108M, 108C, and 108K store toner to be replenished in the developing devices 150Y, 150M, 150C, and 150K, respectively.

The above-described embodiment is an example of using ultrasonic welding as a joining method. Forming the rib-shaped convex portion as the energy director by integral molding can enhance the accuracy of the shape and the position. An adhesive member that melts by ultrasonic waves or heat generation by other ways may be disposed and welded between the workpieces to be welded, instead of integrally molding the welding protrusions. Further, joints may be formed by an adhesive instead of welding.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A powder container case comprising:

a first member and a second member joined to form an edge portion of a case opening;

a main joint disposed between the first member and the second member, the main joint having an end portion at the edge portion of the case opening; and an additional joint disposed adjacent to the end portion of the main joint, wherein the additional joint is parallel to a section of the main joint which is closest to the additional joint, wherein the first member includes a first-member opening that opens in a direction different from a direction in which the case opening opens, wherein the first-member opening shares one side with the case opening, and wherein the second member covers the first-member opening, wherein the main joint between the first member and the second member includes a pair of linear joints, wherein each one of the pair of linear joints has a first end at an edge portion of each end of the one side and extends around a different side of the first-member opening, wherein each one of the pair of linear joints has a second end at a center portion of another side of the first-member opening opposite the one side, and wherein the second end of one of the pair of linear joints overlaps the second end of the other of the pair of linear joints by a specified amount at the center portion of said another side of the first-member opening.

2. The powder container case according to claim 1, wherein the additional joint is disposed at a position away from the main joint with respect to an edge of the first-member opening.

3. The powder container case according to claim 1, wherein the end portion of the main joint is visible between the first member and the second member joined.

4. The powder container case according to claim 1, wherein the main joint is a welded joint.

5. The powder container case according to claim 1, further comprising a seal on the edge portion of the case opening at which the end portion of the joint is located, wherein the seal covers the end portion and contacts the first member and the second member.

6. The powder container case according to claim 1, wherein:

in order for toner to leak through the additional joint, the toner must leak through the main joint.

7. The powder container case according to claim 1, wherein the additional joint includes an end portion at a position different from the end portion of the main joint at the edge portion of the case opening.

8. The powder container case according to claim 7, wherein the additional joint extends parallel to the edge portion of the case opening.

9. The powder container case according to claim 7, wherein the additional joint extends from a position different from the end portion of the main joint, and wherein the end portion of the additional joint is disposed at the edge portion of the case opening.

10. A developing device comprising:

a developer bearer; and the powder container case according to claim 1, wherein the developer bearer is disposed in the powder container case such that a portion of the developer bearer is exposed from the case opening to outside of the powder container case.

11. An image forming apparatus comprising the developing device according to claim 10.

12. A developing device comprising:

a developer bearer; and a powder container case including:

a first member and a second member joined to form an edge portion of a case opening;

a main joint disposed between the first member and the second member, the main joint having an end portion at the edge portion of the case opening; and an additional joint disposed adjacent to the end portion of the main joint, wherein the additional joint is parallel to a section of the main joint which is closest to the additional joint, wherein the developer bearer is disposed in the powder container case such that a portion of the developer bearer is exposed from the case opening to outside of the powder container case, the developing device further comprising:

a thickness regulator configured to regulate a layer of developer;

a thickness regulator mount on which the thickness regulator is mounted, and a seal on the edge portion of the case opening at which the end portion of the joint is located, wherein the first member includes:

a first-member opening that opens in a direction different from a direction in which the case opening opens, the first-member opening shares one side with the case opening;

a pair of positioning portions configured to position the thickness regulator mount, each one of the pair of positioning portions being disposed at a position closer to a longitudinal end of the first member than the first-member opening; and a pair of screw holes to which screws are fitted to fix the thickness regulator mount, each one of the pair of screw holes being disposed at a position closer to the longitudinal end of the first member than corresponding one of the pair of positioning portions, wherein a surface of the first member on which the pair of screw holes are disposed protrudes by a certain amount beyond a surface of the first member on which the pair of positioning portions are disposed, and the certain amount is smaller than a thickness of the seal, wherein the second member covers the first-member opening, wherein the seal covers the end portion and contacts the first member and the second member, and wherein the thickness regulator is disposed with a gap from the developer bearer.

13. A developing device comprising:

a developer bearer;

a powder container case;

a thickness regulator configured to regulate a layer of developer, the thickness regulator disposed with a gap from the developer bearer; and a doctor mount on which the thickness regulator is mounted, wherein the powder container case includes:

a case opening;

a lower case and an upper cover joined to form the case opening and a surface around the case opening;

a main welding disposed between the lower case and the upper cover, the main welding having an edge adjacent to the surface of the case opening;

a seal disposed on the surface and covering the edge of the main welding; and an additional welding branching from the main welding and an edge of the additional welding is covered by the seal, wherein the lower case includes a lower case opening that opens in a direction different from a direction in which the case opening opens, the lower case opening sharing one side with the case opening, wherein the upper cover covers the lower case opening, wherein the lower case further includes:

a pair of positioning bosses configured to position the doctor mount, each one of the pair of positioning bosses being disposed at a position closer to a longitudinal end of the lower case than the lower case opening; and a pair of screw holes to which screws are fitted to fix the gap, each one of the pair of screw holes being disposed at a position closer to the longitudinal end of the lower case than corresponding one of the pair of positioning bosses, wherein a surface of the lower case on which the pair of screw holes are disposed protrudes by a certain amount beyond a surface of the lower case on which the pair of positioning bosses are disposed, and the certain amount is smaller than a thickness of the seal.

14. A developing device comprising:

a developer bearer;

a powder container case;

a thickness regulator configured to regulate a layer of developer the thickness regulator disposed with a gap from the developer bearer; and a doctor mount on which the thickness regulator is mounted, wherein the powder container case includes:

a case opening;

a lower case and an upper cover joined to form the case opening and a surface around the case opening;

a welding disposed between the lower case and the upper cover, the welding having an end part adjacent to the surface of the case opening; and a seal on the surface and covers the end part of the welding, the end part of the welding extending along the surface, wherein the lower case includes a lower case opening that opens in a direction different from a direction in which the case opening opens, the lower case opening sharing one side with the case opening, wherein the upper cover covers the lower case opening, wherein the lower case further includes:

a pair of positioning bosses configured to position the doctor mount, each one of the pair of positioning bosses being disposed at a position closer to a longitudinal end of the lower case than the lower case opening; and a pair of screw holes to which screws are fitted to fix the gap, each one of the pair of screw holes being disposed at a position closer to the longitudinal end of the lower case than corresponding one of the pair of positioning bosses, wherein a surface of the lower case on which the pair of screw holes are disposed protrudes by a certain amount beyond a surface of the lower case on which the pair of positioning bosses are disposed, and the certain amount is smaller than a thickness of the seal.

15. A powder container case comprising:

a first member and a second member joined to form an edge portion of a case opening;

a main joint disposed between the first member and the second member, the main joint having an end portion at the edge portion of the case opening; and an additional joint disposed adjacent to the end portion of the main joint, wherein the first member includes a first-member opening that opens in a direction different from a direction in which the case opening opens, wherein the first-member opening shares one side with the case opening, wherein the second member covers the first-member opening, wherein the main joint between the first member and the second member includes a pair of linear joints, wherein each one of the pair of linear joints has a first end at an edge portion of each end of the one side and extends around a different side of the first-member opening, wherein each one of the pair of linear joints has a second end at a center portion of another side of the first-member opening opposite the one side, and wherein the second end of one of the pair of linear joints overlaps the second end of the other of the pair of linear joints by a specified amount at the center portion of said another side of the first-member opening.

16. A developing device comprising:

a developer bearer;

a thickness regulator configured to regulate a layer of developer on the developer bearer; and a powder container case, including:

a first member and a second member joined to form an edge portion of a case opening;

a main joint disposed between the first member and the second member, the main joint having an end portion at the edge portion of the case opening; and an additional joint disposed adjacent to the end portion of the main joint, wherein the developer bearer is disposed in the powder container case such that a portion of the developer bearer is exposed from the case opening to outside of the powder container case, and wherein the thickness regulator is disposed with a gap from the developer bearer.

* * * * *